US007481190B2

(12) United States Patent
Scuderi

(10) Patent No.: US 7,481,190 B2
(45) Date of Patent: Jan. 27, 2009

(54) SPLIT-CYCLE ENGINE WITH DISC VALVE

(75) Inventor: Salvatore C. Scuderi, Westfield, MA (US)

(73) Assignee: Scuderi Group, LLC, West Springfield, MA (US)

( * ) Notice: Subject to any disclaimer, the term of this patent is extended or adjusted under 35 U.S.C. 154(b) by 260 days.

(21) Appl. No.: 11/589,537

(22) Filed: Oct. 30, 2006

(65) Prior Publication Data

US 2007/0204814 A1 Sep. 6, 2007

Related U.S. Application Data

(60) Provisional application No. 60/778,049, filed on Mar. 1, 2006.

(51) Int. Cl.
*F02B 33/00* (2006.01)
*F02B 33/02* (2006.01)

(52) U.S. Cl. ..... 123/70 R; 123/68

(58) Field of Classification Search ..... 123/68, 123/70 R; 60/39.6

See application file for complete search history.

(56) References Cited

U.S. PATENT DOCUMENTS 4,663,938 A * 5/1987 Colgate ..... 123/70 V

* cited by examiner

*Primary Examiner*—Noah Kamen
(74) *Attorney, Agent, or Firm*—Fildes & Outland, P.C.

(57) ABSTRACT

A split-cycle engine with disc valve includes a crankshaft, a power cylinder and a compression cylinder. A gas crossover passage interconnects the compression cylinder and the power cylinder. An air intake port circumscribes a periphery of the compression cylinder and defines an outer valve seat. An annular ring having a generally central opening is disposed between the compression cylinder and the air intake port and forms a washer valve for opening and closing the air intake port. A disc valve member is concentrically mounted over the central opening of the annular ring. The disc valve member includes a piston portion having a sidewall biased into engagement with the outer valve seat for controlling flow between the compression cylinder and the gas crossover passage.

19 Claims, 10 Drawing Sheets

UNLOADING VALVE CLOSED
DISC VALVE CLOSED
WASHER VALVE OPEN

UNLOADING VALVE CLOSED
DISC VALVE OPEN
WASHER VALVE CLOSED

UNLOADING VALVE OPEN
DISC VALVE CLOSED
WASHER VALVE CLOSED

GT- Power Check Valve Characterization

ITE vs. Piston-Head Clearances for Varying Inlet Valve Max ΔP (2400 rpm)

IMEP vs. Piston-Head Clearance for Varying Inlet Valve Max ΔP (2400 rpm)

ITE of Disc Valve Concept (0.1 mm P-H Clearance and 0.2 bar MaxΔP) vs. Prior Split-Cycle and Conventional Models IMEP of Disc Valve Concept (0.1 mm P-H Clearance and 0.2 bar Max ΔP) vs. Prior Split-Cycle and Conventional Models

SPLIT-CYCLE ENGINE WITH DISC VALVE

CROSS REFERENCE TO RELATED APPLICATION

This application claims the benefit of U.S. Provisional Application No. 60/778,049, filed Mar. 1, 2006.

TECHNICAL FIELD

This invention relates to split-cycle engines and, more particularly, to such an engine incorporating a disc valve.

BACKGROUND OF THE INVENTION

The term split-cycle engine as used in the present application may not have yet received a fixed meaning commonly known to those skilled in the engine art. Accordingly, for purposes of clarity, the following definition is offered for the term split-cycle engine as may be applied to engines disclosed in the prior art and as referred to in the present application.

A split-cycle engine as referred to herein comprises:

a crankshaft rotatable about a crankshaft axis;

a power piston slidably received within a power cylinder and operatively connected to the crankshaft such that the power piston reciprocates through a power (or expansion) stroke and an exhaust stroke during a single rotation of the crankshaft;

a compression piston slidably received within a compression cylinder and operatively connected to the crankshaft such that the compression piston reciprocates through an intake stroke and a compression stroke during a single rotation of the crankshaft; and a gas passage interconnecting the power and compression cylinders, the gas passage including an inlet valve and an outlet (or crossover) valve defining a pressure chamber therebetween.

U.S. Pat. Nos. 6,543,225, 6,609,371, and 6,952,923, all assigned to the assignee of the present invention, disclose examples of split-cycle internal combustion engines as herein defined. These patents contain an extensive list of United States and foreign patents and publications cited as background in the allowance of these patents. The term "split-cycle" has been used for these engines because they literally split the four strokes of a conventional pressure/volume Otto cycle (i.e., intake, compression, power and exhaust) over two dedicated cylinders: one cylinder dedicated to the high pressure compression stroke, and the other cylinder dedicated to the high pressure power stroke.

Conventionally, in a split-cycle type engine, the inlet valve to the gas passage may be a check valve and the outlet valve may be a poppet valve. The inlet check valve permits the one way flow of compressed gas out of the compression cylinder while not allowing its return. Further, split-cycle type engines typically include an inlet valve controlling the flow of gas into the compression cylinder and an exhaust valve controlling flow of exhaust out of the power cylinder, both of which may also be poppet-type valves.

The compression stroke of a split-cycle engine discharges into a high pressure crossover passage, rather than to atmosphere. Accordingly, there is always some gas trapped between the compression piston and the compression cylinder head at top dead center that does not discharge into the crossover passage. This trapped gas must be re-expanded down to approximately one atmosphere before a charge of ambient air can enter the compression cylinder on the intake stroke.

As a result, the swept volume of the compression cylinder in a split-cycle engine must be made larger than that of a conventional engine for the same amount of intake charge. This added volume decreases volumetric efficiency and increases friction of the split-cycle engine. Accordingly, it is desirable to reduce the piston to head clearance of the compression cylinder in a split-cycle engine as much as possible.

SUMMARY OF THE INVENTION

A split-cycle engine generally includes an engine block having a first cylinder and an adjacent second cylinder extending therethrough. A crankshaft is journaled in the block for rotation about a crankshaft axis. Upper ends of the cylinders are closed by a cylinder head.

The first and second cylinders define internal bearing surfaces in which are received for reciprocation a first power piston and a second compression piston, respectively. The cylinder head, the power piston, and the first cylinder define a variable volume combustion chamber in the power cylinder. The cylinder head, the compression piston, and the second cylinder define a variable volume compression chamber in the compression cylinder. The cylinder head also includes an air inlet connected to the compression cylinder for communicating intake gas from an intake passage into the compression cylinder.

A gas passage (or cross-over passage) interconnects the power and compression cylinders. The gas passage includes an inlet and an outlet. The gas passage inlet is in communication with the compression cylinder and the gas passage outlet is in communication with the power cylinder.

The crankshaft includes axially displaced and angularly offset first and second crank throws, having a phase angle therebetween. The first crank throw is pivotally joined by a first connecting rod to the first power piston and the second crank throw is pivotally joined by a second connecting rod to the second compression piston to reciprocate the pistons in their cylinders in timed relation determined by the angular offset of their crank throws and the geometric relationships of the cylinders, crank and pistons.

Alternative mechanisms for relating the motion and timing of the pistons may be utilized if desired. The timing may be similar to, or varied as desired from, the disclosures of the Scuderi patents.

In an internal combustion engine mode of operation, the compression piston draws in and compresses ambient inlet air for use in the power cylinder. Compressed air is admitted to the power cylinder with fuel shortly after the power piston reaches its top dead center (TDC) position at the beginning of an expansion stroke. The fuel/air mixture is then ignited, burned and expanded on the same expansion stroke of the power piston, transmitting power to the crankshaft. The combustion products are discharged on the exhaust stroke.

The present invention provides a disc valve assembly (disc valve) that is both a check valve for the gas passage inlet and a flow control valve for the compression cylinder ambient air inlet. The disc valve assembly generally includes a disc valve outlet that is a check valve for the gas passage inlet and a disc valve inlet that is a washer valve (also referred to as a reed type or ring type suction valve) for the compression cylinder air inlet. The washer valve is also a check-type valve that only allows one-way flow of gases. The disc valve assembly may also include an unloading valve. The disc valve assembly reduces the TDC piston-to-cylinder head (p-h) clearance, thereby reducing the volume of air left in the p-h clearance, i.e. dead space, and increasing the compression ratio and volumetric efficiency. The reduction of p-h clearance also can reduce the cylinder displacement required to achieve a given power and torque level.

A Disc Valve Study is incorporated herein, which shows significant potential improvement of the performance of a split-cycle engine utilizing a disc valve in its compression cylinder. More specifically, the Disc Valve Study illustrates that a disc valve used to replace the intake valves and check valves on the compression cylinder may allow for significant reduction of the piston to head clearance. Additionally, a disc valve with a low disc valve inlet delta pressure (e.g., approximately 0.2 bar or less) and a low piston to head clearance (e.g., approximately 0.25 mm or less) has the potential to significantly increase Indicated Thermal Efficiency (ITE) and Indicated Mean Effective Pressure (IMEP) of the engine.

These and other features and advantages of the invention will be more fully understood from the following detailed description of the invention taken together with the accompanying drawings.

DETAILED DESCRIPTION OF THE INVENTION

Figure 1:
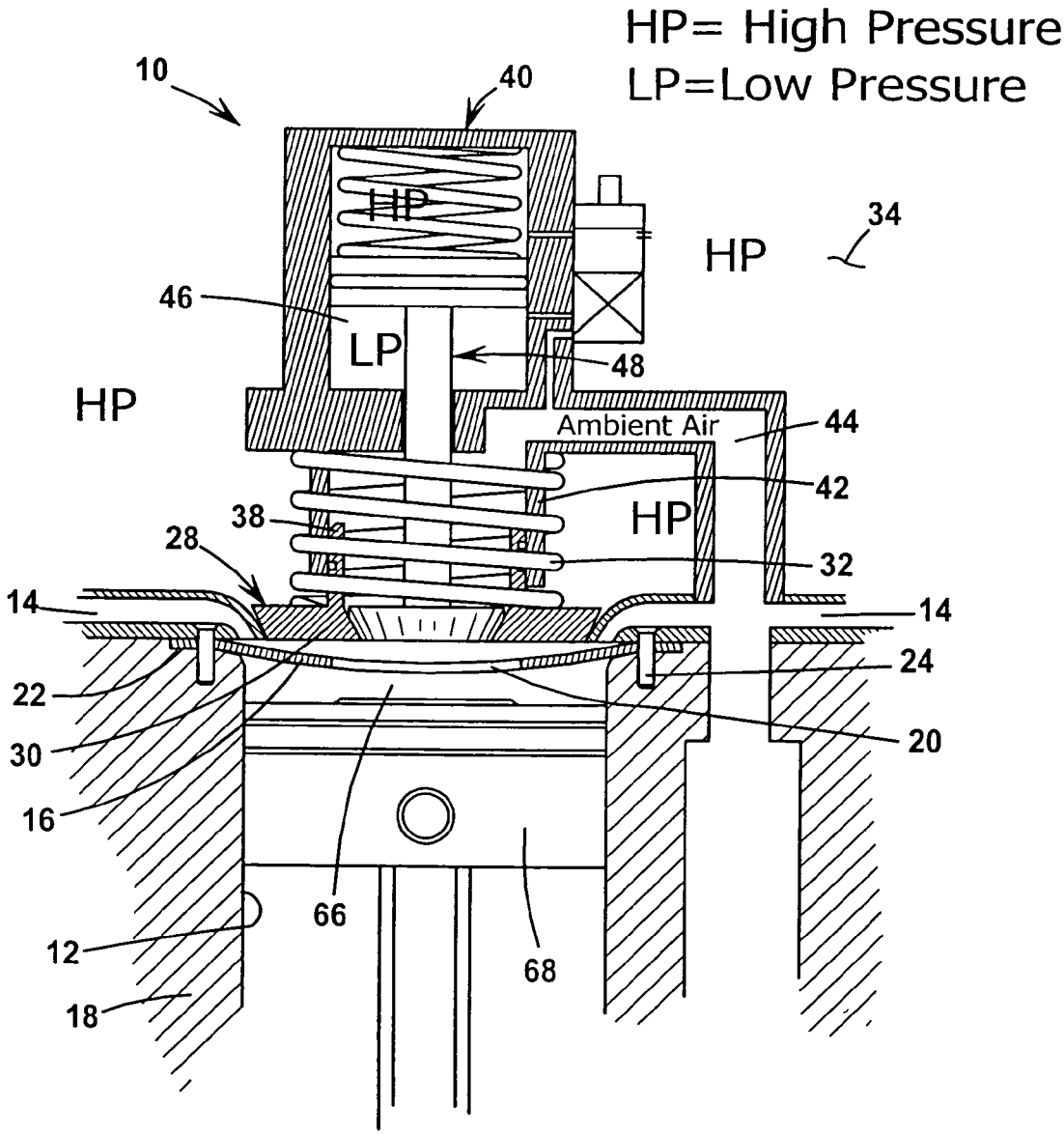
FIG. 1 is a schematic view of a valve assembly in accordance with the present invention for a split-cycle engine illustrating a washer valve of the assembly in an open position, a disc valve of the assembly in a closed position, and an unloading valve of the assembly in a closed position.

Referring now to the drawings in detail, numeral 10 generally indicates an exemplary embodiment of a split-cycle engine having a disc valve in accordance with the invention. Engine 10, shown schematically, is generally of the split-cycle type such as that disclosed in U.S. Pat. Nos. 6,543,225, 6,609,371, and 6,952,923 (Scuderi patents), herein incorporated by reference in their entirety.

Figure 2:
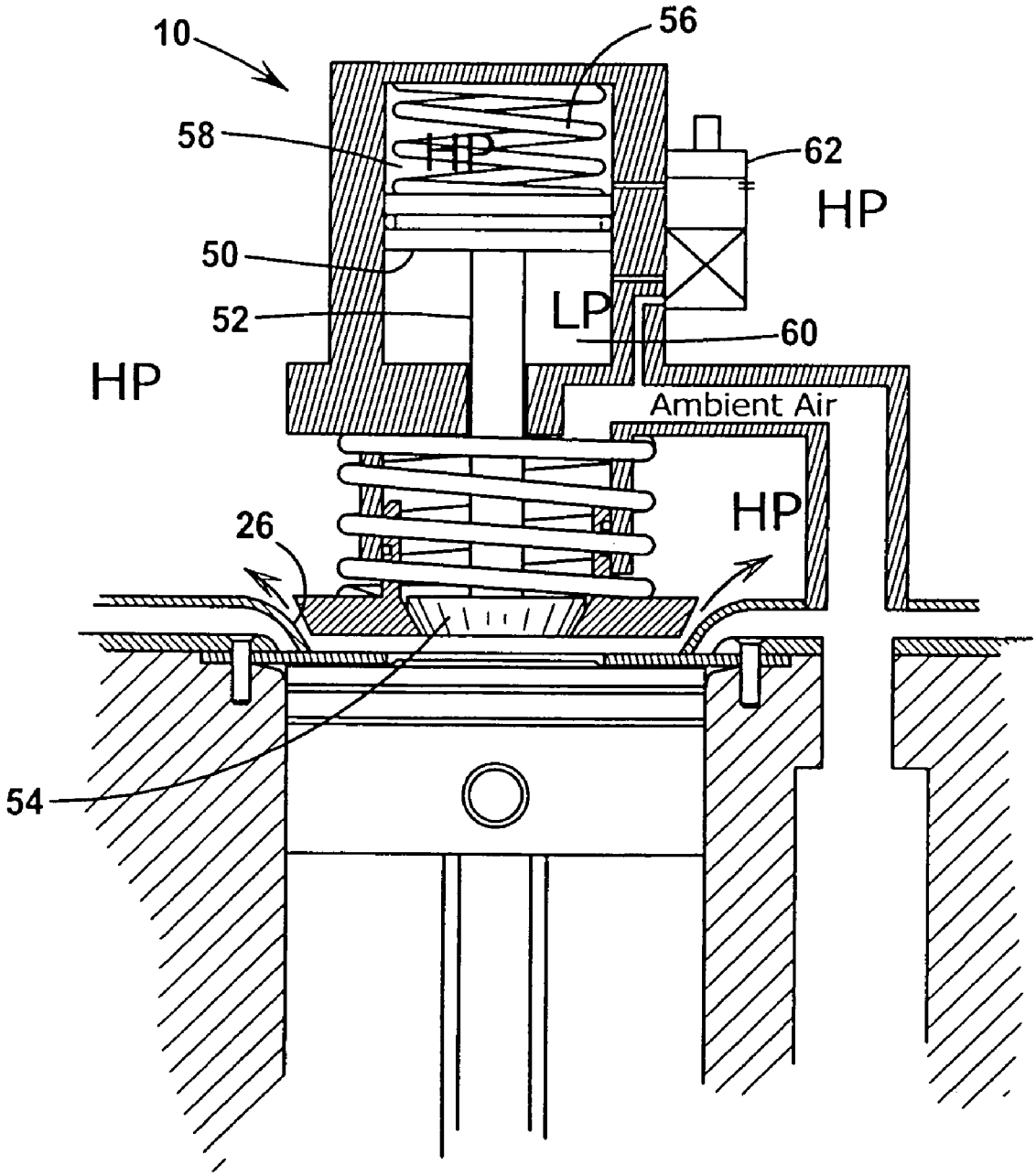
FIG. 2 is a schematic view of the valve assembly of FIG. 1 illustrating the washer valve in a closed position, the disc valve in an open position, and the unloading valve in a closed position.
Figure 3:
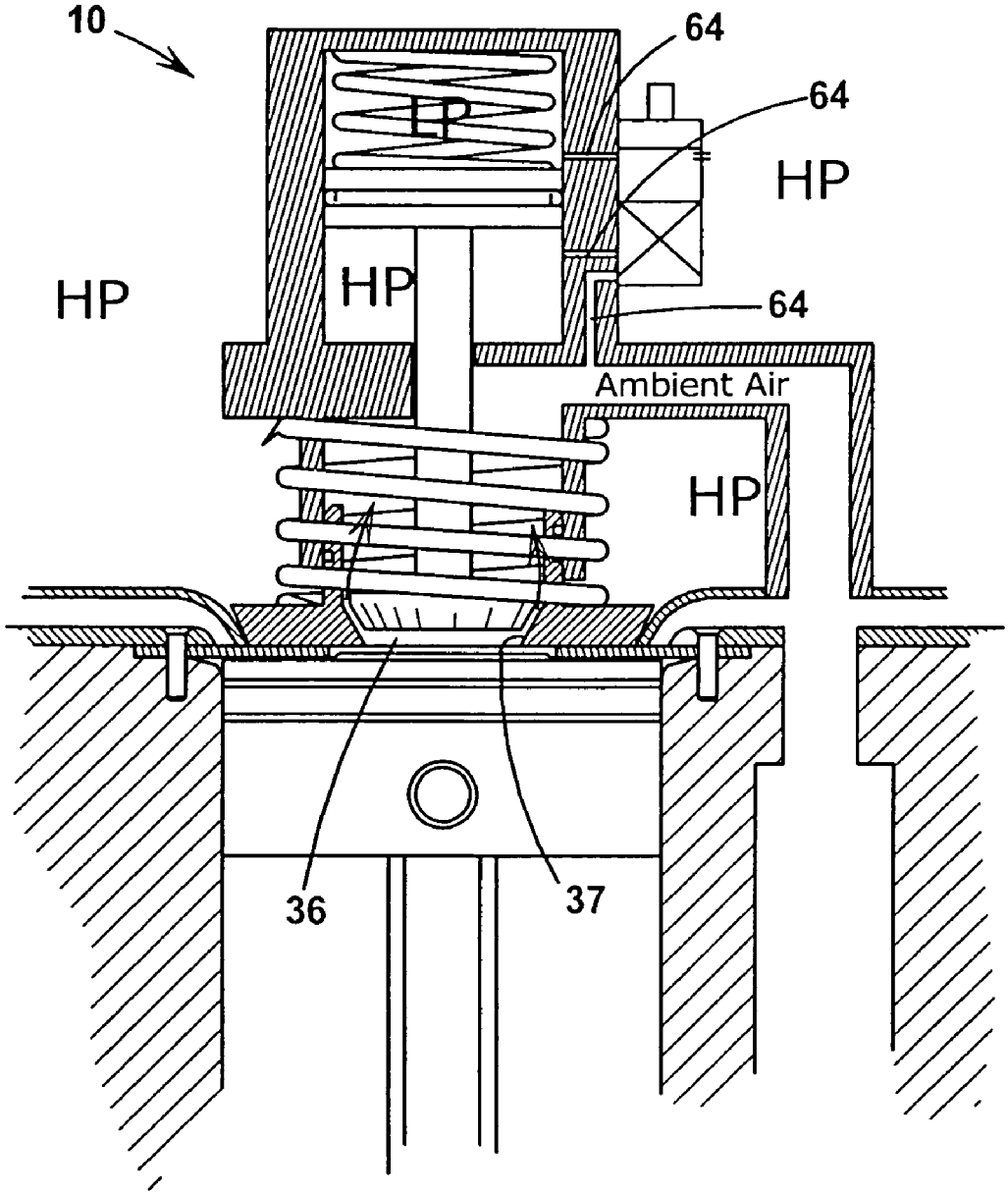
FIG. 3 is a schematic view of the valve assembly of FIG. 1 illustrating the washer valve in a closed position, the disc valve in a closed position, and the unloading valve in an open position.

Referring to FIGS. 1-3, an exemplary embodiment of a disc valve for a split-cycle engine is shown generally at 10. The engine cylinder head (not shown) includes a generally circular opening circumscribing a periphery of the compression cylinder 12 and defining the compression cylinder air inlet passage 14. The disc valve assembly 10 includes a disc valve inlet that is an annular ring 16 disposed between the engine block 18 and the cylinder head about the compression cylinder air inlet passage 14 for opening and closing the compression cylinder air inlet passage 14. The annular ring 16 controls flow of intake gas into the compression cylinder 12. The annular ring 16 also includes a generally central opening 20. The annular ring 16 forms the washer valve 16 and may be a metal spring flap or other material capable of flexing in reaction to a suction force (i.e., negative pressure). The annular ring 16 may include a pair of diametrically opposed radially extending tab portions 22. The tab portions 22 may be received in notched portions of the engine housing adjacent the compression cylinder 12, and a fastener 24 may retain each tab portion 22 in each notch portion to mount the washer valve 16.

An outer edge 26 of the compression cylinder air inlet passage 14 adjacent the compression cylinder 12 defines an outer valve seat 26. A disc valve member 28 (i.e., disc valve outlet) including a piston portion 30 having a sloped (e.g., beveled, truncated conical, or similar) outer sidewall is cooperable with the outer valve seat 26. The disc valve member 28 is biased into engagement with the outer valve seat by a resilient member 32 such as a coil spring or similar. Alternatively, the disc valve member 28 may be hydraulically or pneumatically loaded. The disc valve member 28 is generally disposed between the compression cylinder 12 and the gas passage 34 for controlling flow of compressed gas into the gas passage 34. The disc valve member 28 also includes a generally central opening 36 in the piston portion 30 defined by a sloped (e.g., beveled, truncated conical, or similar) inner sidewall forming an inner valve seat 37. The central opening 36 in the disc valve member 28 is concentric with the central opening 20 in the washer valve 16. A generally cylindrical stem portion 38 extends from the disc valve member 28.

The disc valve assembly 10 further includes a housing 40 generally disposed in the gas passage 34. The housing 40 generally includes a sleeve 42 having an open end, a flow channel 44 connecting the open end to the air inlet passage 12, and a control chamber 46. The stem portion 38 of the disc valve member 28 is received in the sleeve 42 through the open end of the housing 40 and is slidable within the sleeve 42. The stem portion 38 of the disc valve member 28 may include one or more seal rings to seal the clearance between the stem portion 38 and the sleeve 42. The resilient member 32 biasing the disc valve member 28 may be disposed about an outer surface of the sleeve 42 between the piston portion 30 of the disc valve member 28 and an opposite surface of the housing 40.

An unloading valve member 48 is disposed in the housing 40 and includes a piston 50 disposed in the control chamber 46, a stem 52 extending from the piston 50 through the control chamber 46 into the flow channel 44, and a disc-shaped valve portion 54 connected to the stem 52 opposite the piston 50. The valve portion 54 has a sloped outer surface cooperable with the inner valve seat 37 of the disc valve member 28. The unloading valve member 48 is biased into engagement with the inner valve seat 37. The unloading valve member 48 may be spring, hydraulically, or pneumatically loaded, or may be loaded by other similar loading means. In a specific embodiment, the unloading valve member 48 is biased by a spring 56 in the control chamber 46 engaging the piston 50 opposite the stem 52. The piston 50 is slidable within the control chamber 46 and divides the control chamber 46 into a biased side 58 corresponding to the disposition of the spring 56 and an unbiased side 60 opposite the spring 56.

The disc valve assembly 10 may also include a controller 62 in communication with the biased side 58 and unbiased side 60 of the control chamber 46 through, for example, passages 64 in the housing 40. The controller 62 may allow air into the unbiased side 60 of the control chamber 46 from the biased side 58. This causes the valve portion 54 of the unloading valve member 48 to unseat, thereby opening the open end of the sleeve 42 and allowing gas to flow from the compression chamber 66 of the compression cylinder 12 into the flow channel 44 of the housing 40. The unloading valve 48 is a check-type valve that does not allow flow of gases back into the compression cylinder 12.

During an intake stroke of the compression piston 68 (see FIG. 1), the pressure differential between the compression chamber 66 and the air inlet passage 14 created by the movement of the compression piston 68 away from the disc valve assembly 10 causes the washer valve (or disc valve inlet) 16 to deflect inwardly with respect to the compression chamber 66. This allows fluid flow from the air inlet passage 14 into the compression chamber 66. The pressure differential ($\Delta P$) across the washer valve 16 required to open the washer valve 16 is small. The smaller the $\Delta P$ required to open the washer valve 16, the greater the efficiency of the engine as the pumping work necessary to draw in an intake charge is lessened. The $\Delta P$ required to open the washer valve 16 may be between 0.0 and 1.0 bar, but is preferably 0.2 bar or less.

As a compression stroke of the compression piston 68 begins, the washer valve 16 is forced into sealed engagement with the air inlet passage 14, preventing fluid flow back into the air inlet passage 14 during compression of the intake charge. As the compression piston 68 continues to move toward the disc valve assembly 10, the compression piston 68 compresses the intake charge in the compression chamber 66. When the pressure in the compression chamber 66 becomes high enough to overcome the bias of the disc valve member (or disc valve outlet) 28 (FIG. 2), the disc valve member 28 opens and allows the compressed intake charge to enter the gas passage 34. At TDC, the p-h clearance may be between 0.0 and 1.0 mm, but is preferably 0.25 mm or less. Also, as shown in FIG. 2, the controller 62 has set the pressure in the biased side 58 of the control chamber 46 to be higher than the pressure in the unbiased side 60 of the control chamber 46. The unloading valve member 48 is therefore biased into engagement with the inner valve seat 37, keeping the unloading valve member 48 closed.

If an excess pressure condition exists in the compression chamber 66, or if it is otherwise desired to vent the compression chamber 66, the controller 62 can set the pressure in the biased side 58 of the control chamber 46 to be less than the pressure in the unbiased side 60 of the control chamber 46 (FIG. 3). The higher pressure in the unbiased side 60 of the control chamber 46 is sufficient to overcome the biasing force of the spring 56 in the control chamber 46. The piston 50 of the unloading valve member 48 therefore moves away from the compression cylinder 12, unseating the unloading valve member 48 and allowing flow of gas through the opening 36 in the disc valve member 28 into the flow channel 44 in the housing 40. The gas in the flow channel 44 is then vented to the atmosphere through the air inlet passage 14.

DISC VALVE STUDY

The Scuderi Group, LLC of West Springfield, Mass., commissioned the Southwest Research Institute of San Antonio, Tex. to perform the following study (the Study). The Study involves the effects of a disc valve on the performance of a split-cycle engine as previously defined herein and generally described in U.S. Pat. Nos. 6,543,225, 6,609,371, and 6,952,923. The disc valve mechanism in this Study is used to replace the intake valves and crossover (or gas) passage check valves located in the compression cylinder head of the split-cycle engine.

The Study determined that the disc valve has the potential of reducing or eliminating the re-expansion that occurs with the current intake valve lift profile and piston-to-head (p-h) clearance in the compression cylinder. This offers the possibility of minimizing the Top Dead Center (TDC) clearance, which increases Compression Ratio (CR), therefore increasing the volumetric efficiency and reducing the compression cylinder displacement required to achieve a given power or torque level.

For purposes of this Study, an exemplary embodiment of the disc valve was modeled as having a check valve for an outlet that is centered in and covers the majority of the compression cylinder bore (analogous to that of the disc valve member 28 of FIG. 1). The disc valve outlet replaces the check valve typically used as the inlet valve to the crossover passage of a conventional split-cycle engine.

Figure 4:
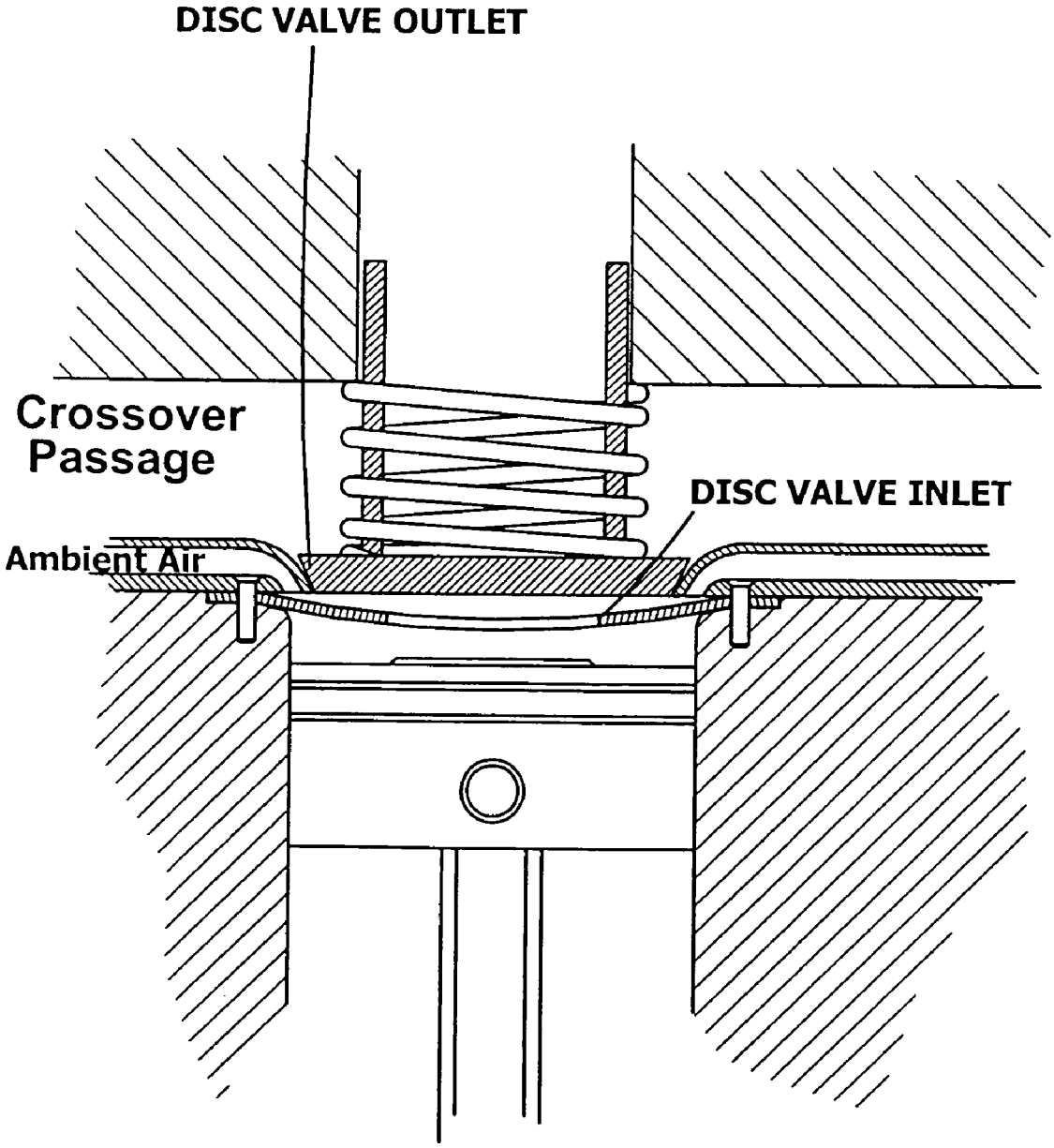
FIG. 4 is a disc valve concept of the Disc Valve Study illustrating the exhaust to crossover passage process.

The disc valve inlet of the disc valve was modeled as an annular ring concentric around the disc valve outlet (analogous to that of the annular ring 16 of FIG. 1). A metal spring flap achieves the one-way characteristics desired for the disc valve inlet. A sketch is shown in FIG. 4.

Though the disc valve was modeled in this Study as a pressure actuated check valve outlet concentrically mounted in an annular ring valve inlet, one skilled in the art would recognize that other types of valve mechanisms may be utilized for the concentric valve-in-valve design of a disc valve. For example, the disc valve outlet may be a poppet valve having a stem that may be pneumatically, hydraulically or cam actuated. Additionally, the ring valve inlet may be of the poppet type also. Moreover, the annular ring of the disc valve may serve as the disc valve outlet for some applications, rather than the disc valve inlet. Also the disc valve inlet and outlet may be actuated in either an inward direction or an outward direction depending on functional requirements.

One of the main advantages of the disc valve relative to a split-cycle engine is that it has the potential to allow greatly reduced TDC compression p-h clearance. This is due to the majority of the compression cylinder head being formed of a spring-loaded check valve. It has been estimated that p-h clearance levels of less than 0.25 mm are achievable with the disc valve design.

Figure 5:
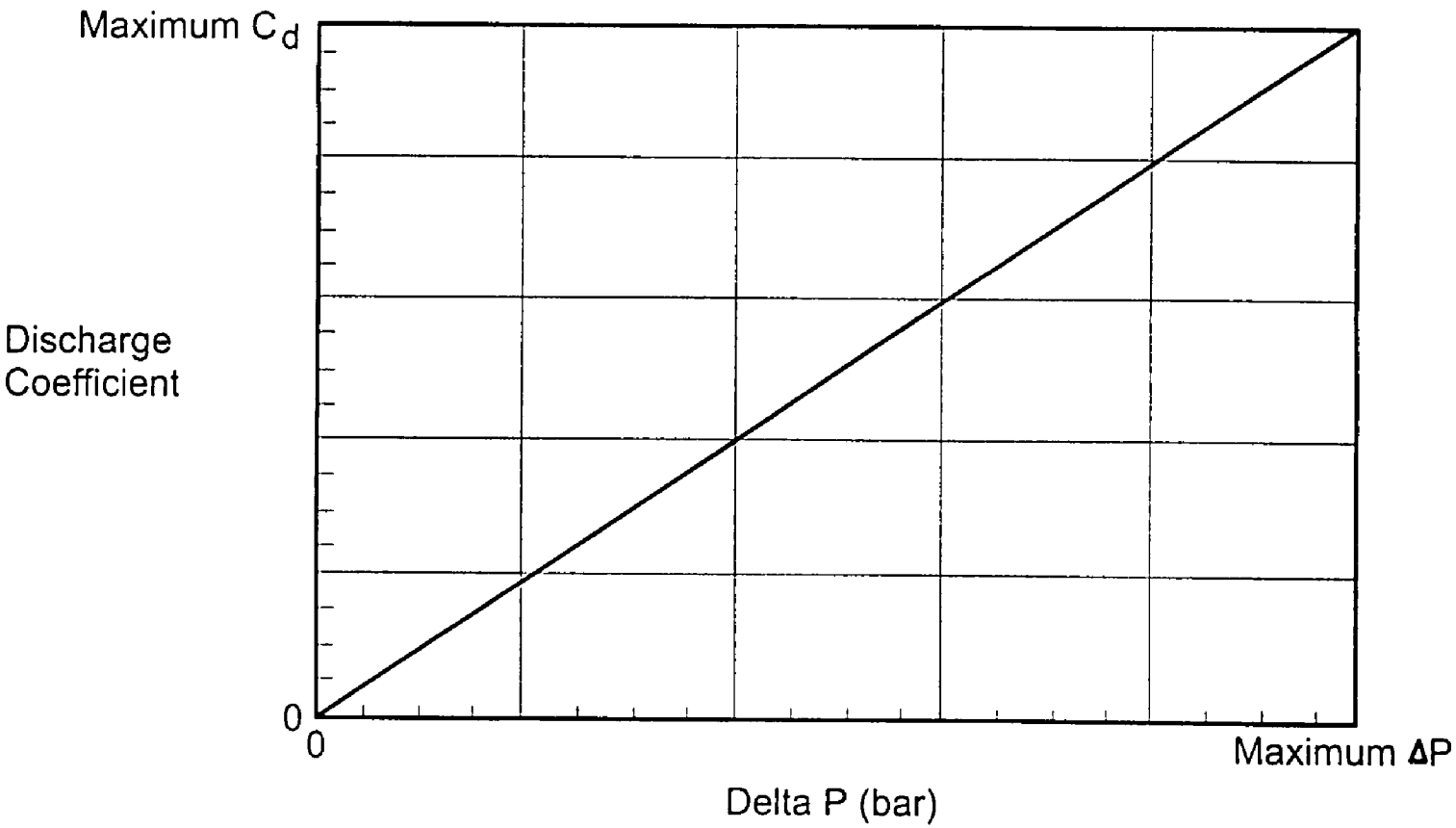
FIG. 5 is a GT-Power Check Valve Characterization graph of discharge coefficient vs. AP of the Disc Valve Study.

This Study was performed in GT-Power software to determine the performance effects of the disc valve applied to the split-cycle engine. The disc valve outlet was modeled in GT-Power as a check valve having a certain reference diameter and included a characteristic describing the discharge coefficient (Cd), which is the effective flow area divided by the reference diameter area, as a function of the pressure difference ($\Delta P$) across the disc valve outlet. FIG. 5 shows the representative characteristic.

Although non-linear characteristics are possible, for this Study a linear relationship was used for the disc valve outlet, which can be fully characterized by the maximum ΔP and the maximum Cd. The important factor is the slope of the line, which can be changed by either of the controlling values. Valve performance is increased by either a lower maximum ΔP or an increase in maximum Cd, in other words, a steeper, more vertical line in FIG. 5.

The Study began by baseline modeling a typical Non-Disc Split-Cycle Engine having a conventional poppet type intake valve and a check valve for the inlet valve to the crossover passage. Additionally, a Conventional Engine having the standard four strokes of the Otto cycle performed in each cylinder over two revolutions of the crankshaft was also baseline modeled.

Figure 6:
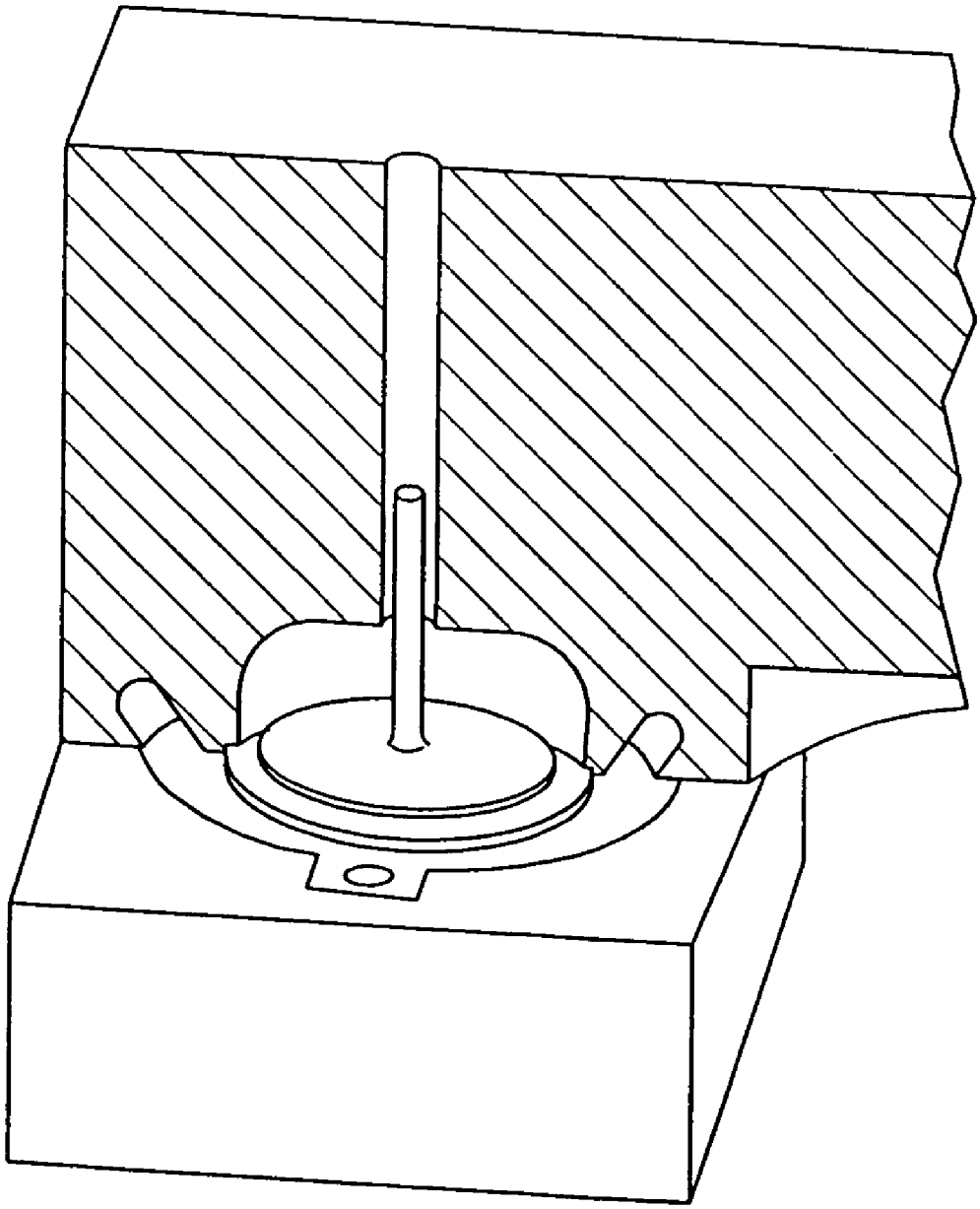
FIG. 6 is a disc valve concept applied to a Split-Cycle Engine of the Disc Valve Study.

The Study then modeled a Disc Valve Split-Cycle Engine by replacing the conventional check valve inlet to the crossover passage of the Non-Disc Split-Cycle Engine with one of a larger diameter check valve, commensurate with the disc valve outlet design, as illustrated in FIG. 6.

The maximum Cd for the disc valve outlet was swept between 0.20 and 0.99 and showed weak effects on engine performance. That is, Indicated Thermal Efficiency (ITE), which is the thermal efficiency based on the net indicated power, varied less than 0.5 points and Indicated Mean Effective Pressure (IMEP), which is the indicated engine torque per displacement volume, varied about 0.1 bar for that broad range of Cd values. Still, higher Cd or lower ΔP to open the inlet valve to the crossover passage is potentially advantageous for performance.

Next, the cam-actuated intake poppet valves of the Non-Disc Split-Cycle Engine were replaced with check valves, commensurate with the disc valve annular ring inlet design. In the model, this was done with two check valves sized to match the total area of the concept layout of the disc valve inlet applied to the split-cycle engine. The Cd was set at 0.5 and the ΔP to open the disc valve inlet was swept from 0.1 to 1.0 bar.

Because the disc valve inlet is an inlet valve, it needs to open with a small ΔP, but it must also withstand fairly high anti-flow direction pressures (approximately 50 bar) during the compression stroke. However, the high anti-flow direction pressures are applied only periodically during relatively small portions of the total intake and compression stroke cycle in the compression cylinder. Therefore, it is estimated that a disc valve inlet designed to withstand these intermittent high anti-flow pressures can also achieve ΔP opening pressures of approximately 0.2 bar or less.

During the next step in the Study, the compression piston-head (p-h) clearance was swept from 1.0 mm to 0.1 mm. Because of the relatively large diameter of the disc valve outlet, and because the p-h clearance is not limited by the combustion process, it is estimated that p-h clearances of 0.25 mm are achievable.

Figure 7:
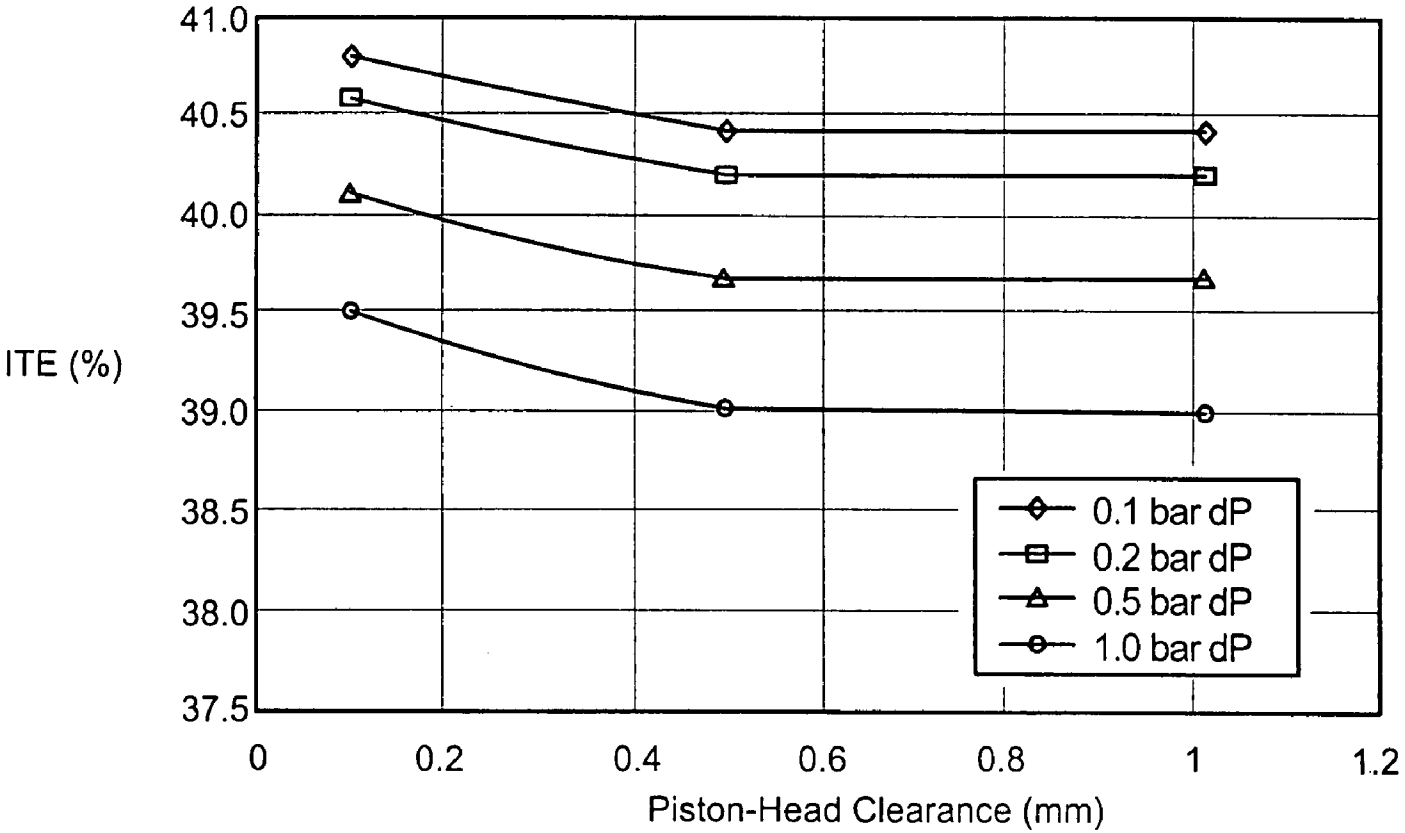
FIG. 7 is a graph of ITE vs. Piston-Head clearances for varying disc valve inlet maximum ΔP at 2400 rpm of the Disc Valve Study.

The Study was performed at 2400 and 4000 rpm (full-load) with the results shown at 2400 rpm only for clarity. FIG. 7 below shows the ITE of the engine at 2400 rpm as a function of compression cylinder p-h clearance on the horizontal axis. The various lines are given at various levels of maximum disc valve inlet ΔP values.

By following any line of FIG. 7 from left to right, one can see that the effect on ITE of compression cylinder p-h clearance is minimal, with only about a 0.5 point ITE advantage from such a reduction in clearance. This is the expected result since reduction in p-h clearance has the effect of reducing the re-expansion of any pressurized gas trapped at the top of the compression stroke (i.e., any high pressure gas that does not pass through the disc valve outlet into the crossover passage during a compression stroke, and must be re-expanded down to approximately 1 bar before any ambient air can be drawn into the compression cylinder on the intake stroke). This re-expansion does not strongly affect ITE, since during re-expansion, the engine is able to recover the energy from the high pressure gases.

However, looking vertically from one line to the next on FIG. 7 shows that dropping the max disc valve inlet ΔP from 1.0 bar to 0.1 bar (from the line marked with diamond shaped points to the line marked with circular points) increases ITE by over one full point at a given p-h clearance value. Again, this is a very reasonable result in that the restriction across the disc valve inlet will directly impact the pumping work necessary to bring in the ambient air intake charge and therefore a more restrictive disc valve inlet will reduce ITE. For reference, the Non-Disc Split-Cycle Engine model has a predicted ITE at 2400 rpm of 40.2%.

Figure 8:
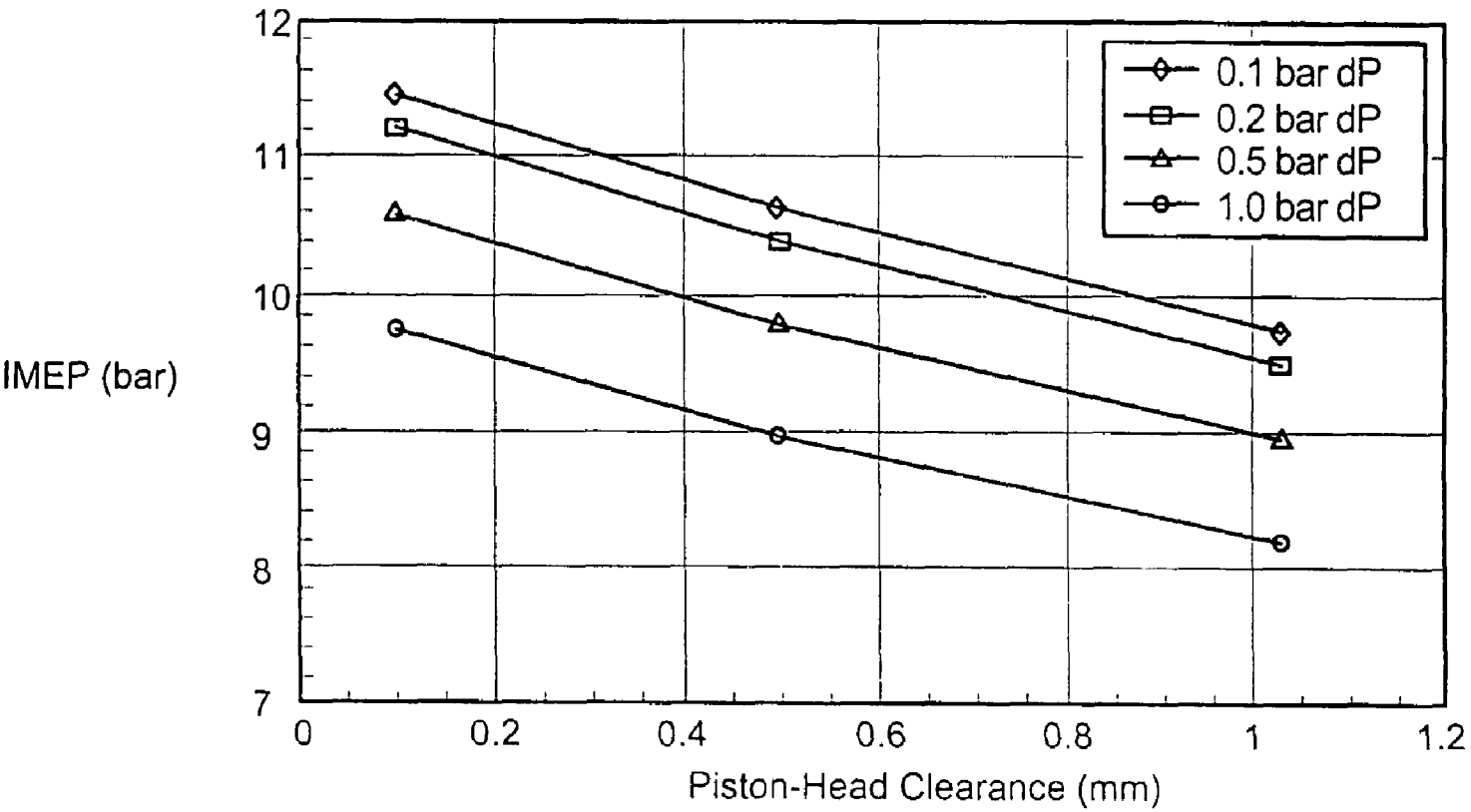
FIG. 8 is a graph of IMEP vs. Piston-Head Clearance for varying disc valve inlet maximum ΔP at 2400 rpm of the Disc Valve Study.

FIG. 8 shows the same type of comparison but gives the effect on IMEP, which can be thought of generally as a type of specific torque or torque per displacement. The trend is quite different, with a strong effect of p-h clearance on IMEP and a weaker but significant effect from disc valve inlet ΔP.

Going across a given line in FIG. 8, one can see that reducing the p-h clearance can potentially provide roughly 1.5 bar IMEP, or an approximate 15% increase. This is also a reasonable prediction, as the p-h clearance will directly affect the percentage of the charge in the compression cylinder which is expelled to the crossover passage and is therefore available for combustion on each cycle. The disc valve inlet restriction has a weaker effect on IMEP, since it mainly affects the work required to get the air in, and to a lesser extent, the mass of air that will be inducted. The latter is only affected by the likelihood of the more restrictive disc valve inlet to close a bit earlier at the end of the intake stroke. For reference, the Non-Disc Split-Cycle Engine model predicts an IMEP at 2400 rpm of 9.3 bar.

The important result regarding sensitivity is to understand that a 15% increase in IMEP is potentially achievable depending on the characteristics of the valve and the minimum achievable p-h clearance. In addition to the Study, current estimates by industry experts indicate that a disc valve inlet ΔP of 0.2 bar or less, and a compression cylinder p-h clearance of 0.25 mm or less are achievable for split-cycle engine applications. If such estimated characteristics hold true, then a split-cycle engine having a disc valve design would have a significant advantage over a Non-Disc Valve Split-Cycle Engine. The sensitivity could be summarized as the disc valve inlet restriction mainly affecting ITE while the p-h clearance mainly affects IMEP.

Figure 9:
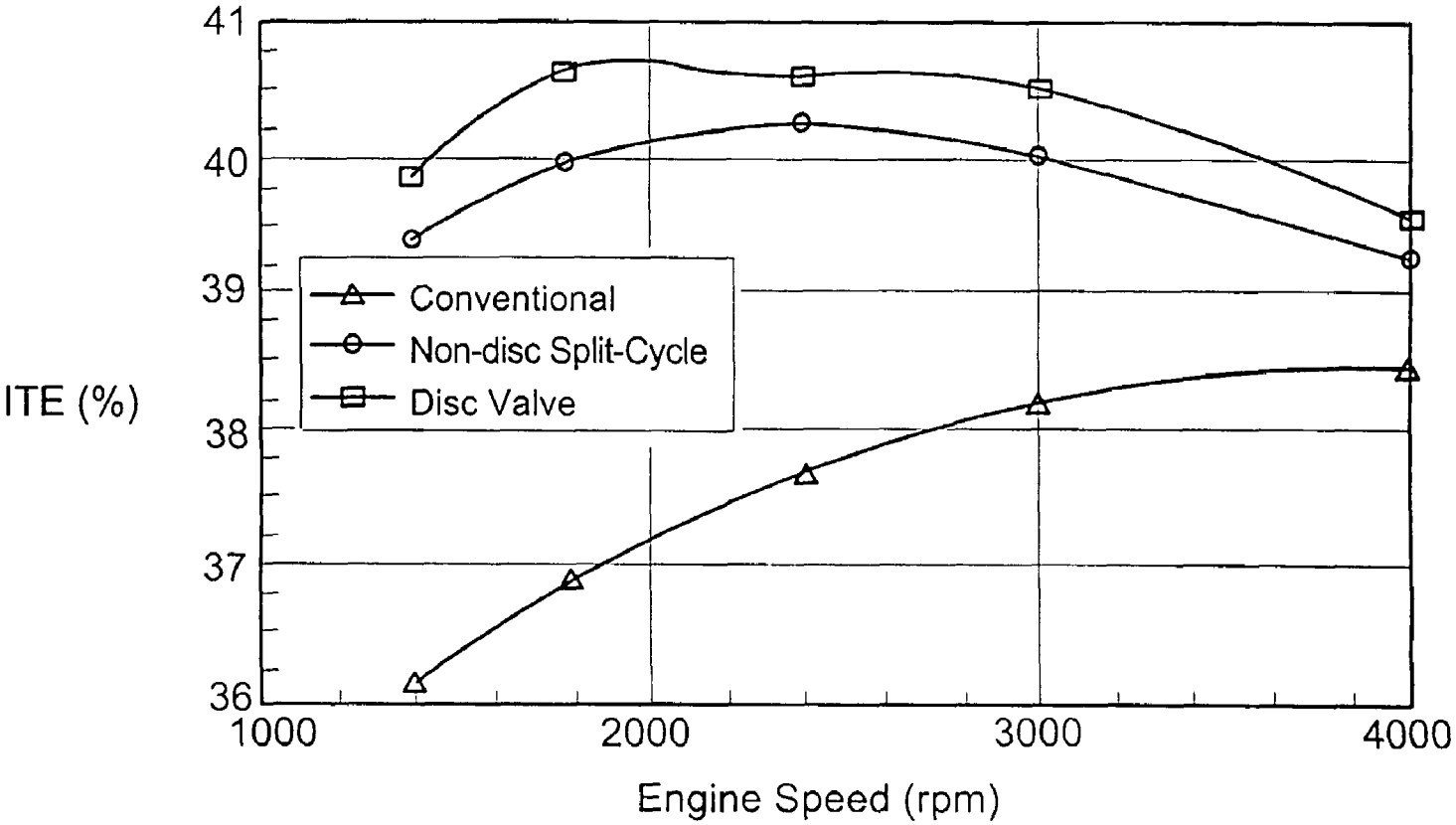
FIG. 9 is a graph of ITE of the Disc Valve Engine (having 0.1 mm P-H Clearance and 0.2 bar maximum disc valve inlet ΔP) vs. Non-Disc Split-Cycle Engine and Conventional Engine of the Disc Valve Study.
Figure 10:
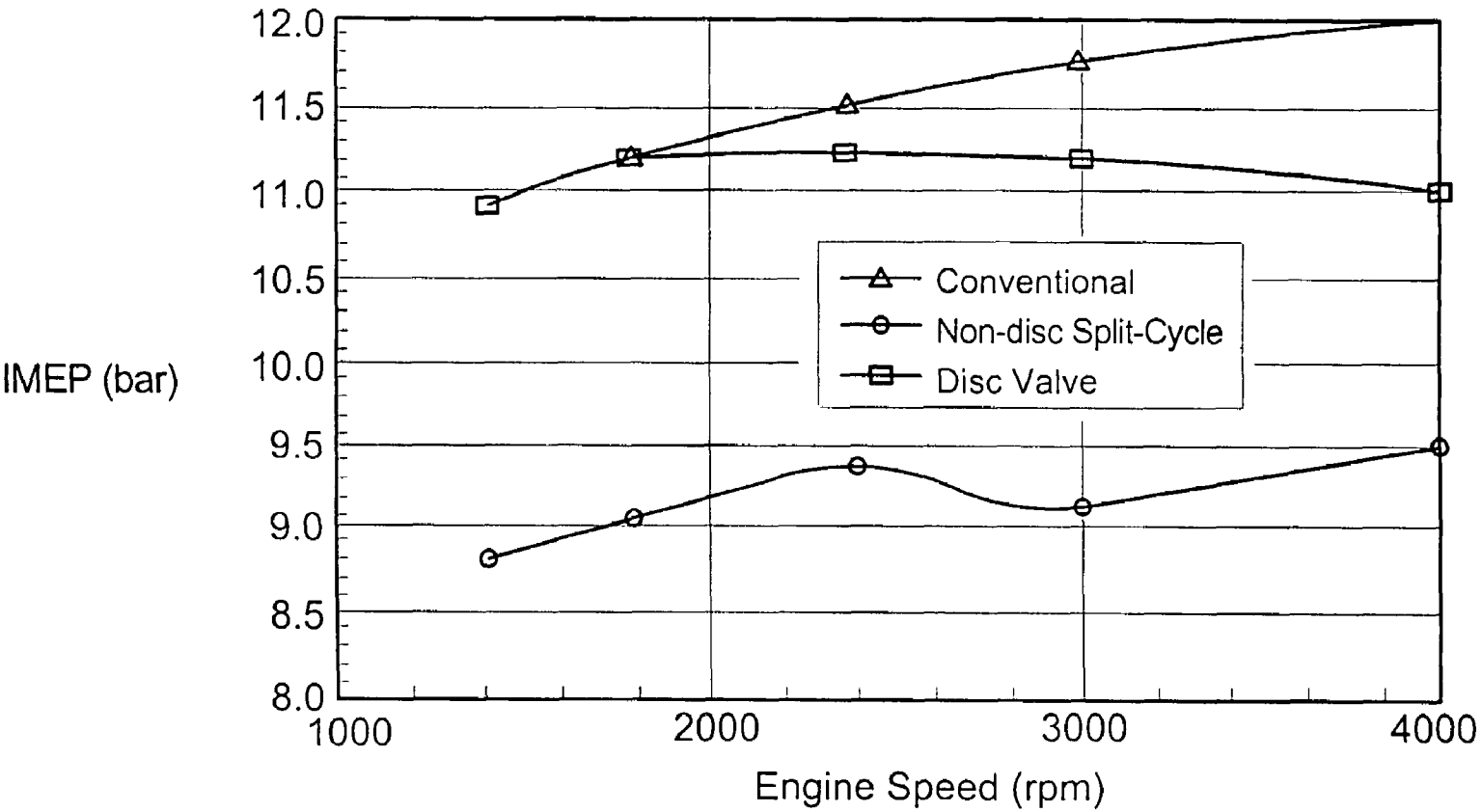
FIG. 10 is a graph of IMEP of the Disc Valve Engine (having 0.1 mm P-H Clearance and 0.2 bar maximum disc valve inlet ΔP) vs. Non-Disc Split-Cycle Engine and Conventional Engine of the Disc Valve Study.

Finally, in the Study the model was run across the speed range with a selection of parameter values from the above study. Optimistic, but potentially achievable, values (p-h clearance of 0.1 mm and a maximum disc valve inlet ΔP of 0.2 bar) were selected for the Disc Valve Split-Cycle Engine concept. FIGS. 9 and 10 present the comparison (ITE and IMEP respectively) of the Disc Valve Split-Cycle Engine against the baseline Non-Disc Split-Cycle Engine and the Conventional Engine.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A disc valve assembly for a split-cycle engine, the disc valve assembly comprising:

a generally circular air inlet having a central axis;

an axially flexible washer-shaped annular ring having a generally central opening, the annular ring being adjacent said air inlet and forming a washer valve for opening and closing said air inlet;

a generally circular outer valve seat adjacent said air inlet;

a housing including a sleeve having an open end, a flow channel through said sleeve, and a control chamber;

a disc valve member including a stem portion received in said sleeve through said sleeve open end and a piston portion connected to the stem portion, the piston portion having a sloped outer sidewall biased into engagement with said outer valve seat and a generally central opening defined by a sloped inner sidewall that forms an inner valve seat concentric with the central opening in said washer valve; and an unloading valve member disposed in said housing, the unloading valve member including a piston disposed in said control chamber, a stem extending from the piston through said control chamber and into said flow channel, and a disc-shaped valve portion connected to the stem opposite the piston, the disc-shaped valve portion having a sloped outer surface cooperable with said inner valve seat;

said unloading valve member being biased into engagement with said inner valve seat.

2. The disc valve assembly of claim 1, wherein the piston of said unloading valve member is slidable within said control chamber and divides said control chamber into a biased portion and an unbiased portion.

3. The disc valve assembly of claim 2, further including a controller in communication with said biased portion and said unbiased portion of said control chamber, wherein the controller controls the pressure in said biased portion and said unbiased portion, thereby selectively seating and unseating said unloading valve member.

4. The disc valve assembly of claim 1, including a resilient member in said biased portion of said control chamber engaging the piston of said unloading valve member to bias said unloading valve member into engagement with said inner valve seat.

5. The disc valve assembly of claim 1, including a resilient member biasing said disc valve member into engagement with said outer valve seat.

6. The disc valve assembly of claim 5, wherein said resilient member surrounds the sleeve of said housing.

7. The disc valve assembly of claim 1, including a seal ring between the stem portion of said disc valve member and said sleeve.

8. The disc valve assembly of claim 1, wherein the sleeve and the stem portion of said disc valve member are concentric cylinders.

9. A split-cycle engine comprising:

a crankshaft rotatable about a crankshaft axis;

a cylinder bank including a power cylinder and a compression cylinder;

a power piston slidably received within the power cylinder and operatively connected to the crankshaft such that the power piston reciprocates through an expansion stroke and an exhaust stroke during a single rotation of the crankshaft;

a compression piston slidably received within the compression cylinder and operatively connected to the crankshaft such that the compression piston reciprocates through an intake stroke and a compression stroke during a single rotation of the crankshaft;

a gas crossover passage interconnecting the compression cylinder and the power cylinder;

an air intake port having an open end circumscribing a periphery of the compression cylinder and an outer surface adjacent the open end that defines an outer valve seat;

an annular ring having a generally central opening, the annular ring being disposed between the compression cylinder and the air intake port adjacent the open end of the air intake port forming a washer valve for opening and closing the air intake port; and a disc valve member concentrically mounted over the central opening of the annular ring, the disc valve member including a piston portion having a sidewall biased into engagement with the outer valve seat for controlling flow between the compression cylinder and the gas crossover passage;

whereby during the intake stroke of the compression piston, the washer valve opens to allow intake air to be drawn into the compression cylinder, and during the compression stroke, the washer valve closes and the disc valve member opens to allow compressed intake air to enter the gas crossover passage from the compression cylinder.

10. The split-cycle engine of claim 9, wherein said annular ring includes peripheral tabs for mounting said annular ring to the cylinder bank.

11. The split-cycle engine of claim 9, further comprising a valve housing including a sleeve having an open end, the valve housing being disposed in the gas crossover passage;

wherein said disc valve member is received in said sleeve through said sleeve open end.

12. The split-cycle engine of claim 11, including a resilient member surrounding the sleeve of said valve housing and biasing said disc valve member into engagement with said outer valve seat.

13. The split-cycle engine of claim 11, including a seal ring between said disc valve member and said sleeve.

14. The split-cycle engine of claim 11, wherein the sleeve and a stem portion of said disc valve member are concentric cylinders.

15. The split-cycle engine of claim 11, wherein:

the piston portion of said disc valve member has a generally central opening defined by a sloped inner sidewall that forms an inner valve seat concentric with the central opening in said washer valve;

the valve housing includes a flow channel through said sleeve and a control chamber; and an unloading valve member is disposed in said valve housing, the unloading valve member including a piston disposed in said control chamber, a stem extending from the piston through said control chamber and into said flow channel, and a disc-shaped valve portion connected to the stem opposite the piston, the disc-shaped valve portion having a sloped outer surface cooperable with said inner valve seat;

wherein said unloading valve member is biased into engagement with said inner valve seat.

16. The split-cycle engine of claim 15, wherein the piston of said unloading valve member is slidable within said control chamber and divides said control chamber into a biased portion and an unbiased portion.

17. The split-cycle engine of claim 16, further including a controller in communication with said biased portion and said unbiased portion of said control chamber, wherein the controller controls the pressure in said biased portion and said unbiased portion, thereby selectively seating and unseating said unloading valve member.

18. The split-cycle engine of claim 15, including a resilient member in said biased portion of said control chamber engaging the piston of said unloading valve member to bias said unloading valve member into engagement with said inner valve seat.

19. The split-cycle engine of claim 15, wherein the flow channel in said valve housing is in communication with the air intake port;

whereby opening of said unloading valve member allows compressed air in said compression cylinder to enter said flow channel and pass to said air intake port.

* * * * *